US005332106A

United States Patent [19]

Schlotte et al.

[11] Patent Number: 5,332,106

[45] Date of Patent: Jul. 26, 1994

[54] SPOON AND FORK HOLDER

[76] Inventors: Alice M. Schlotte; Virgil H. Schlotte, both of 17483 64th St. SW., Cokato, Minn. 55321

[21] Appl. No.: 991,752

[22] Filed: Dec. 17, 1992

[51] Int. Cl.[5] ..... A47F 7/00

[52] U.S. Cl. ..... 211/70.7; 211/49.1; 248/37.3; D7/637

[58] Field of Search ..... 211/70.7, 49.1; 248/37.3; 206/553; D7/637

[56] References Cited

U.S. PATENT DOCUMENTS

D. 167,946 10/1952 Liblick ..... 248/37.3

2,829,852 4/1958 Smith et al. ..... 211/49.1 X 4,305,629 12/1981 Friis ..... 211/70.7 X

FOREIGN PATENT DOCUMENTS 614559 12/1948 United Kingdom ..... 211/70.7

*Primary Examiner*—Robert W. Gibson, Jr.

[57] ABSTRACT

A device for holding a plurality of spoon and fork eating utensils in stabilized stacked relation, which provides a stacking slot for each of the utensil stacks and provides stability for the stack both by lateral stabilizing elements as well as permitting the bottommost utensil of a stack to engage the table top surface both under the utility and handle ends thereof.

3 Claims, 1 Drawing Sheet

SPOON AND FORK HOLDER

BACKGROUND OF THE INVENTION

In the past, it has been a problem to provide silverware on a buffet or serving table in a neatly arranged and attractively displayed fashion. A number of different organizers have been provided, mostly for the storage of silverware, such as silverware chests and the like and also carrying devices which serve as storage organizers; however, these do not maintain a neat arrangement of the silverware on a table. Some of these are relatively complicated and are large and cumbersome units which detract from the display if used on a the table. None of these has proved to be satisfactory to solve the problem solved by the present invention.

SUMMARY OF THE INVENTION

This invention provides a small unitary holder for spoon and/or fork eating utensils which not only maintains the utensils in stacked relation, but provides a firm support on the table top so that the stacked pieces will be maintained in their aligned stacked relationship. Each holder unit is provided with one or more individual stacking slots which extend downwardly a sufficient distance to permit the bottom fork or spoon to engage the table top and firmly support the utensils in a stable stacked relationship within the stacking slot. Each unit will display the stacked utensils without detracting from the design. The holders can also be used to carry the pieces to the table as well as storing the pieces if desired.

DETAILED DESCRIPTION OF THE PREFERRED EMBODIMENT

Figure 1:
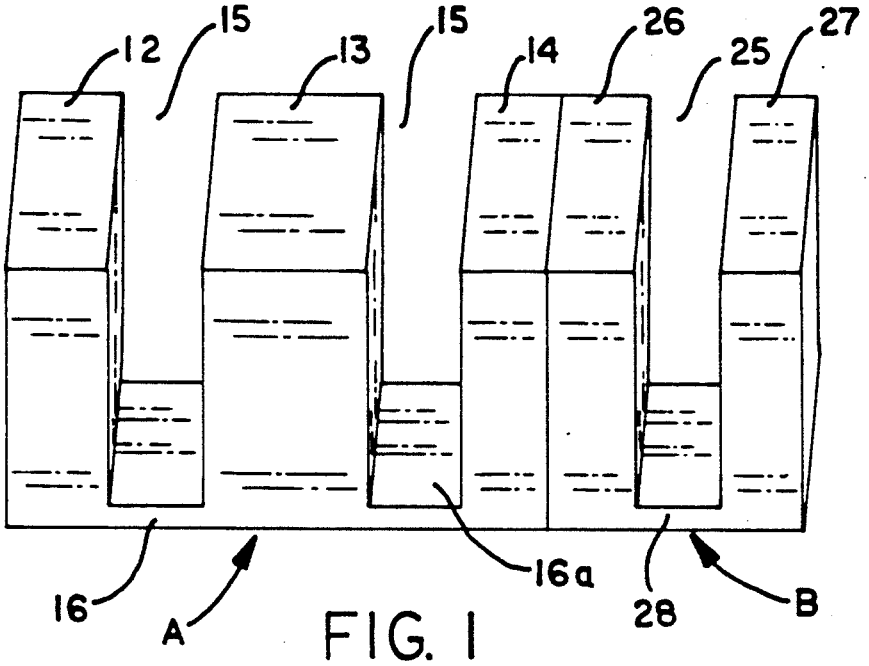
FIG. 1 is a perspective view of holders embodying the invention.

Two forms of the invention are illustrated in FIG. 1. One of these provides two parallel stacking slots for holding a plurality of spoon and/or fork eating utensils in neatly arranged stacked relationship. This form is designated by the letter A. Form B is also illustrated, which includes only a single stacking slot.

Figure 2:
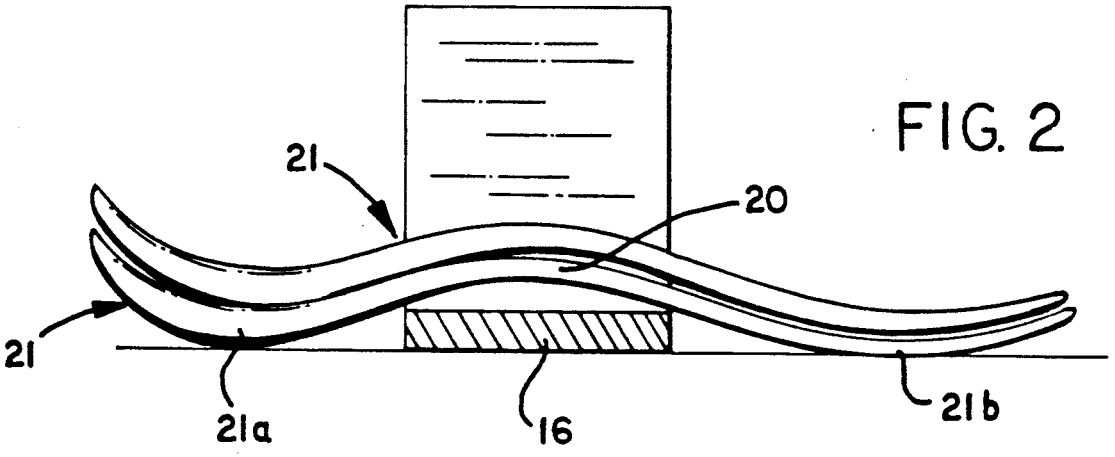
FIG. 2 is a sectional view through a holder mounted on a table top with utensils therein.

In Form A of the invention, upstanding stabilizing elements 12, 13 and 14 are provided as illustrated. The spaced elements 12 and 13, as well as elements 13 and 14, are spaced apart to define a pair of stacking slots 15. The width of the stacking slots 15 is slightly greater than the width of the arched neck portion 20 of the spoon or fork utensils 21 to be received therein, but narrow enough to maintain the utensils in confined, neatly stacked relation therein. Both of these slots 15 are provided with a lower connector portion 16 which forms the bottom surface 16*a* of the respective slots 15 and rigidly connects the bottom of the stabilizing elements defining the slots 15. The vertical thickness and front to back width of each of each of lower connector portions 16 is respectively slightly less than the height and length of the intermediate arch portions 20 of utensil pieces 21 placed in a selected slot 15, as shown in FIG. 2. This permits the bottom of the utility portion 21*a* of the bottommost utensil piece, as well as the bottom of the handle portion 21*b* to rest on and be supported by the surface of the table, with the intermediate arch portion 20 raised above the bottom surface 16*a* of the respective slot 15, as shown in FIG. 2.

The utensil pieces 21 all nest one on top of the other, and the arch portions 20 are confined in the respective slots 15 to be stabilize a stack of utensils with the bottommost utensil firmly supported on the surface of the table on which the holder is positioned.

In Form B of the invention, a single slot 25 is formed between upstanding spaced stabilizing elements 26 and 27. A single lower connector portion 28 rigidly connects the bottom portions of the upstanding stabilizing elements 26 and 27. The thickness and width of the lower connector portion 28 is slightly less than the height and length of the intermediate arch portion 20 of the utensil pieces 21 placed in the slot 25 so that the bottom surface of the utensil portion 21*a* and handle portion 21*b* will rest on and be supported by the surface of the table, as best shown in FIG. 2.

It will be seen that this invention provides a holder for spoon and fork eating utensils to maintain a plurality of eating utensils in neatly arranged, stacked relationship on the surface of the table. A holder for a single stack of utensils, such as is employed in Form B of the invention, may be used when only a small number of the same utensils are required, and Form A discloses a plurality of rigidly inter-connected stacked slots for stably supporting eating utensils on a table top.

What is claimed is:

1. A device for holding a plurality of fork and spoon eating utensils in stabilized stacked relation on a table top, said eating utensils being of the type having an arched neck portion with a utility end portion and a handle end portion respectively extending outwardly in opposite directions from said arched neck portion, said device comprising at least one pair of spaced apart, upstanding stabilizing elements, defining at least one stacking slot therebetween, the width of each stacking slot being slightly greater than the width of the respective neck portions of the utensils being stacked therein, connector means connecting the bottom of the stabilizing elements and having a vertical thickness less than the height of the arch portion of the utensils to be placed in the slot, and having a length less than the length of the arch of the utensil to permit the bottom of the utility portion and bottom of the handle portion to rest on the surface of the table supporting the holding device.

2. The structure set forth in claim 1 wherein only one pair of spaced upstanding stabilizing elements is provided to define a single stacking slot therebetween to hold a single stack of eating utensils.

3. The structure set forth in claim 1 wherein at least two pair of upstanding stabilizing elements are provided to produce a pair of stacking slots to hold at least two stacks of eating utensils, with the bottom utensil stack being supported on the table top surface.

* * * * *